US009059528B2

(12) United States Patent
Wang

(10) Patent No.: US 9,059,528 B2
(45) Date of Patent: Jun. 16, 2015

(54) SIGNAL CONNECTOR ANTI-THEFT DEVICE SET

(75) Inventor: Cheng-Hui Wang, New Taipei (TW)

(73) Assignee: EZCONN CORPORATION, Taipei (TW)

( * ) Notice: Subject to any disclaimer, the term of this patent is extended or adjusted under 35 U.S.C. 154(b) by 829 days.

(21) Appl. No.: 13/346,802

(22) Filed: Jan. 10, 2012

(65) Prior Publication Data

US 2013/0178081 A1 Jul. 11, 2013

(51) Int. Cl.
*H01R 13/44* (2006.01)
*H01F 27/04* (2006.01)
*H01R 13/443* (2006.01)

(52) U.S. Cl.
CPC ..... *H01R 13/443* (2013.01); *Y10T 29/5313* (2015.01)

(58) Field of Classification Search
IPC ..... H01F 27/02,27/04; H01R 13/44
See application file for complete search history.

(56) References Cited

U.S. PATENT DOCUMENTS 8,453,937 B2 * 6/2013 Kolton et al. ..... 235/492
2006/0145873 A1 * 7/2006 Feibelman et al. ..... 340/572.9

* cited by examiner

*Primary Examiner* — Tuyen Nguyen
(74) *Attorney, Agent, or Firm* — Bacon & Thomas, PLLC

(57) ABSTRACT

A signal connector anti-theft device set includes a cap, a rotating member defining multiple through holes and rotatably set in the cap, a locking member abutted against the rotating member in the cap and having a driven structure facing toward the through holes of the rotating member, and a hand tool having a working tip for rotating the rotating member into accurate alignment with the driven structure of the rotating member and then inserting through the through holes of the rotating member into the driven structure to rotate the locking member between a locking position and an unlocking position.

11 Claims, 12 Drawing Sheets

SIGNAL CONNECTOR ANTI-THEFT DEVICE SET

BACKGROUND OF THE INVENTION

1. Field of the Invention

The present invention relates to a signal connector protection technology and more particularly, to a signal connector anti-theft device set, which provides a specially designed hand tool as a key for locking/unlocking a signal connector anti-theft device.

2. Description of the Related Art

CATV (Community Antenna Television) is often used to mean "Cable TV". By means of fiber optic networks and switch nodes, radio signal is transmitted through coaxial cables and signal distributors into TV receivers or computers in individual homes to provide different services, such as broadcast TV, digital TV, on-demand entertainment, and/or high-speed internet service.

Further, when establishing a fiber optic network, coaxial cables are hung on posts or the outside walls of buildings, and signal connectors with nuts are used to connect cable ends of coaxial cables to individual signal distributors. To avoid illegal connection of TV signal. A connector stopper may be fastened to each unsubscribed signal connector. A special tool must be used to lock a connector stopper to a signal connector of a signal distributor.

FIGS. 11 and 12 illustrate a hand tool B for fastening a conventional signal connector anti-theft device A to a signal connector C of a signal distributor for anti-theft protection. The signal connector anti-theft device A comprises an outer cap A1, and an inner socket A2 accommodated in the outer cap A1. The inner socket A2 comprises a fastening means, for example, inner thread A21 at one end, and an engagement structure A22 at the other end. The engagement structure A22 comprises a conical portion A222 and a plurality of teeth A221 around the conical portion A222. The hand tool B comprises a tool shank B1 having a forked end portion B2, and a push block B21 pivotally coupled to the forked end portion B2. During installation, the tool shank B1 of the hand tool B is inserted into the outer cap A1 to stop the push block B21 axially against the conical portion A222 of the engagement structure A22, and then the hand tool B is pushed forwards to bias the push block B21 along the conical surface of the conical portion A222 into engagement with the teeth A221, and then the hand tool B1 is rotated, driving the inner thread A21 into engagement with the outer thread C1 of the signal connector C.

According to the aforesaid prior art design, the size and angle of the push block B21 must be precisely made for driving the engagement structure A22 of the inner socket AZ. However, the push block B21 and the teeth A221 may wear quickly with use. When the push block B21 or the teeth A221 starts to wear, the push block B21 may be slip from the teeth A221 during operation. Further, as this design of signal connector anti-theft device A has been intensively used in the market, an evil person can get a common hand tool easily to unfasten a signal connector anti-theft device from a signal connector of a signal distributor.

Therefore, there is a strong demand for a signal connector anti-theft device set that eliminates the aforesaid problems.

SUMMARY OF THE INVENTION

The present invention has been accomplished under the circumstances in view. It is therefore the main object of the present invention to provide a signal connector anti-theft device, which provides a custom-made characteristic, assuring a high level of security.

To achieve this and other objects of the present invention, a signal connector anti-theft device set is adapted for fastening to a signal connector of an electronic implement for protection. The signal connector anti-theft device comprises a cap, which comprises an accommodation chamber, a tubular neck located on one end thereof in communication with the accommodation chamber and an opening located on an opposite end thereof in communication with the accommodation chamber, a rotating member, which is set in the accommodation chamber of the cap, comprising a circular flat base and a plurality of through holes cut through the circular flat base, a locking member, which is set in the accommodation chamber and abutted against the rotating member, comprising a coupling chamber for receiving the signal connector of the electronic implement, a coupling structure located on one end thereof for coupling to the signal connector of the electronic implement and a driven structure located on an opposite end thereof, and a hand tool, which is insertable through the tubular neck of the cap and the through holes of the rotating member for rotating the locking member, comprising a tool shank, a tool handle located one end of the tool shank and a working tip located on an opposite end of the tool shank. The working tip comprises a plurality of driving blocks insertable through the through holes of the rotating member and engageable into the driven structure of the locking member.

Further, the driven structure can be configured in one of rectangular, arch, circular, elliptical and polygonal shapes, having radially extending ribs. Further, the driving blocks of the working tip of the tool handle can be configured in one of rectangular, arch, circular, elliptical and polygonal shapes, and spaced from one another at an equal or different angle.

Subject to the design of the driving blocks of the working tip of the hand tool to match with the through holes of the rotating member and the driven structure of the locking member, the precision requirement of the component parts is less critical. Further, the component parts have a strong structural strength and will not wear quickly with use.

DETAILED DESCRIPTION OF THE PREFERRED EMBODIMENT

Figure 1:
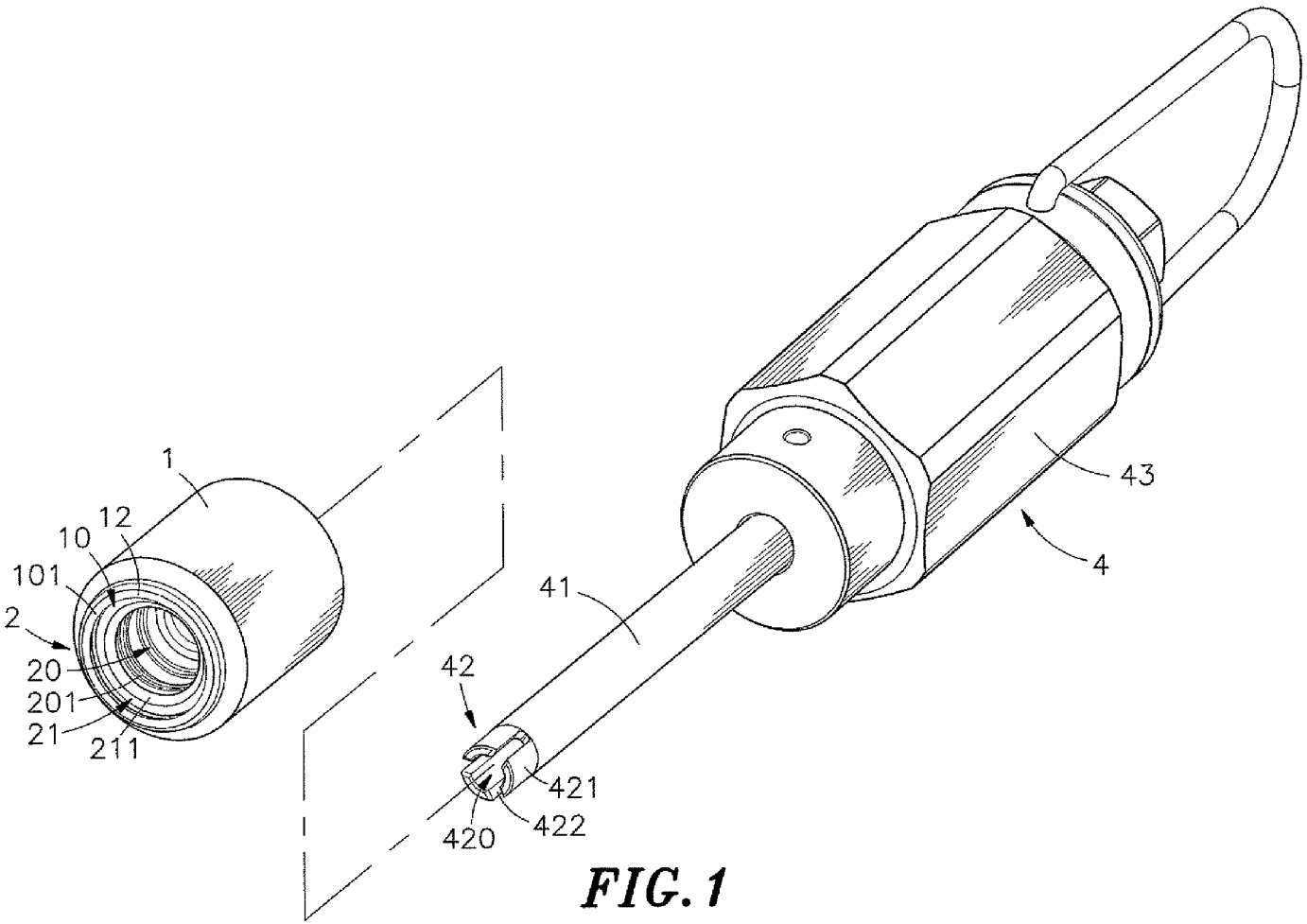
FIG. 1 is an elevational view of a hand tool and a signal connector anti-theft device in accordance with the present invention.
Figure 2:
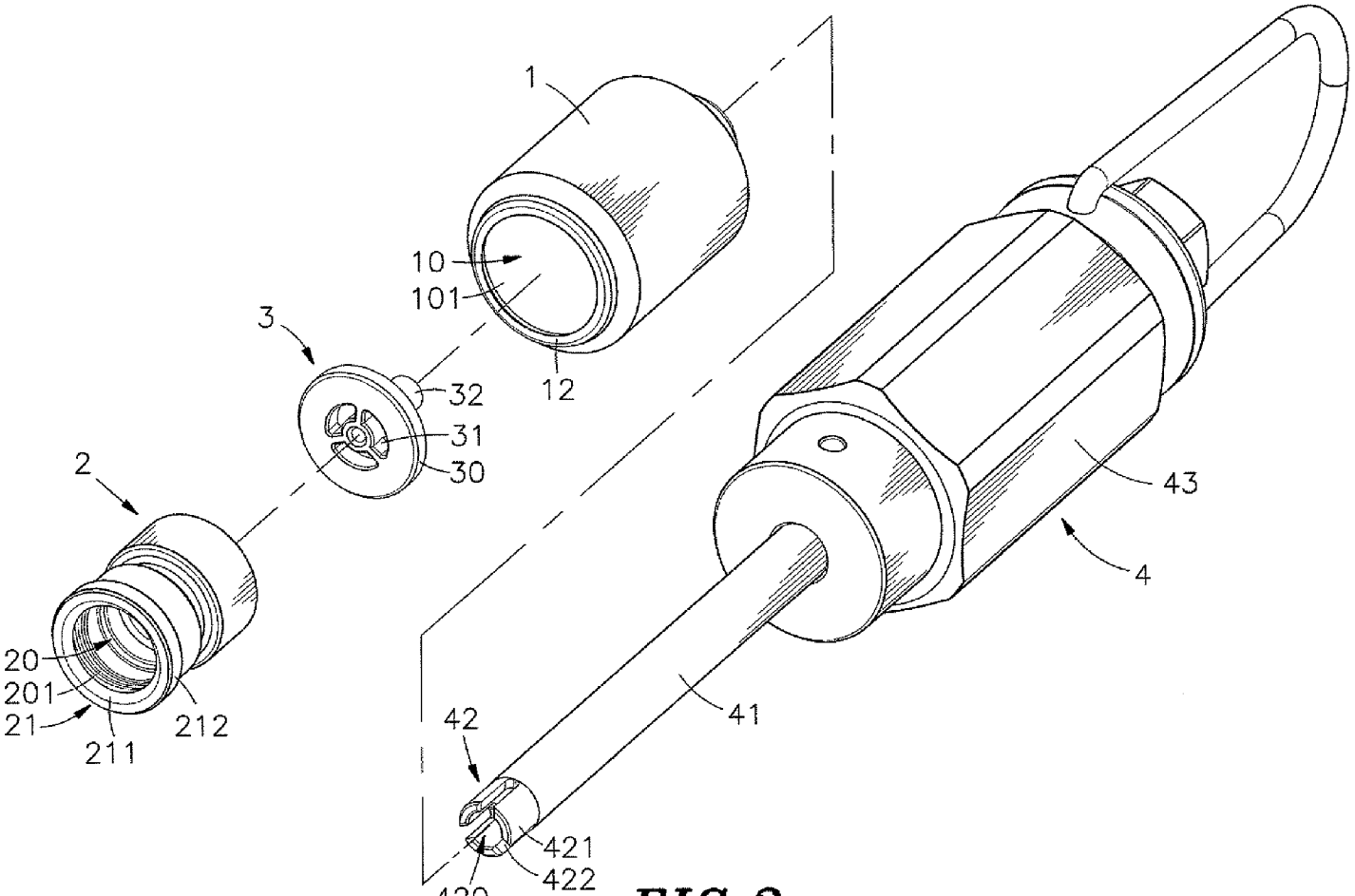
FIG. 2 is an exploded view of the signal connector anti-theft device set in accordance with the present invention.
Figure 3:
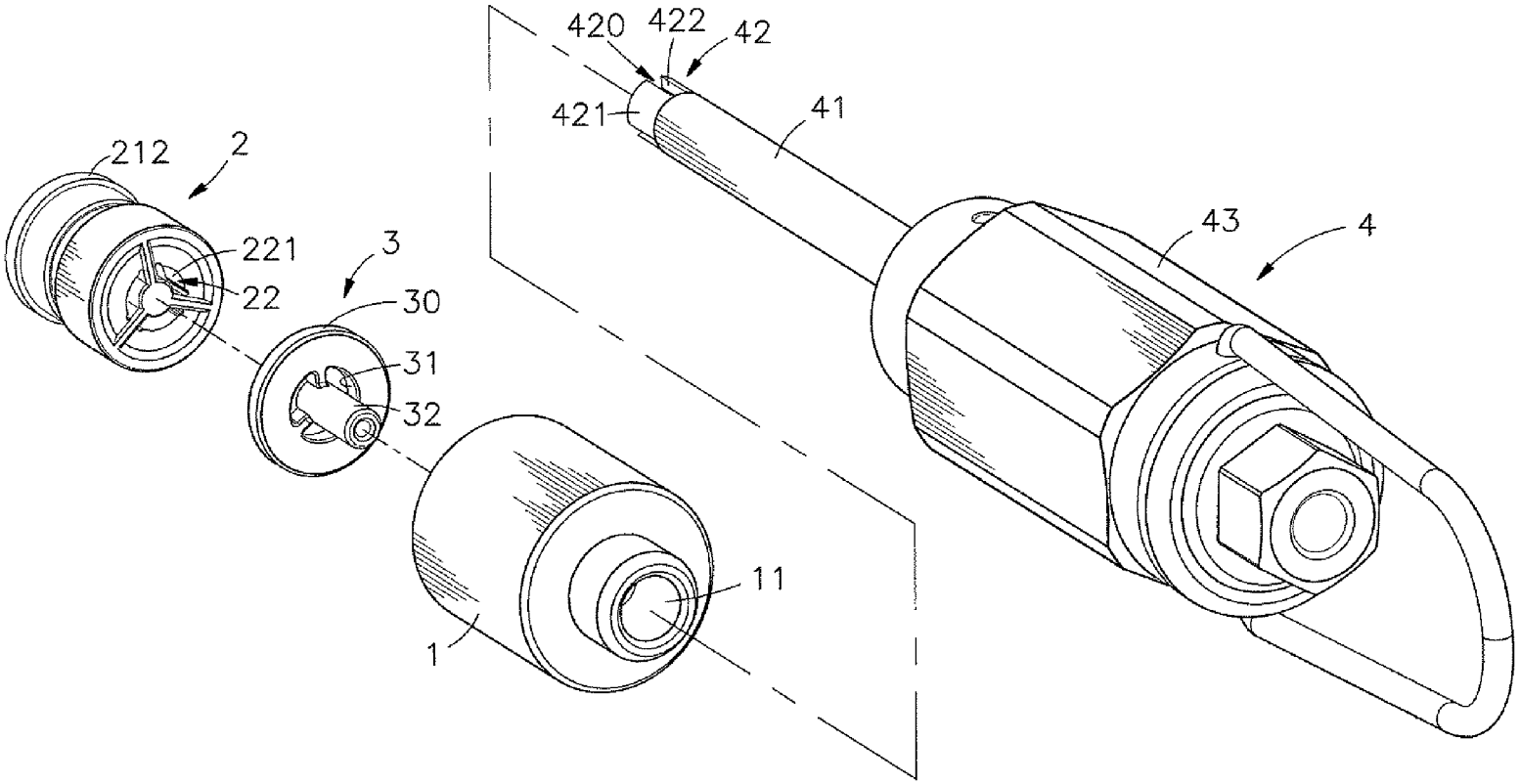
FIG. 3 corresponds to FIG. 2 when viewed from another angle.
Figure 4:
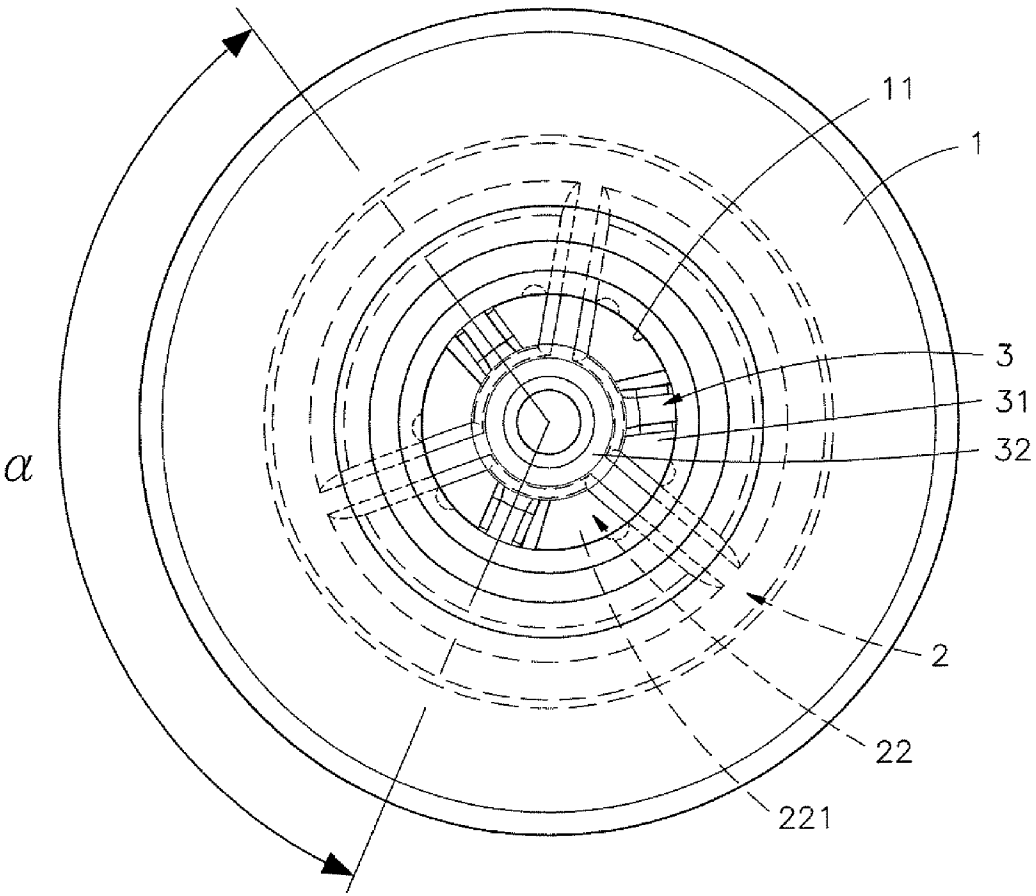
FIG. 4 is a schematic rear side view in an enlarged scale of the signal connector anti-theft device in accordance with the present invention.
Figure 5:
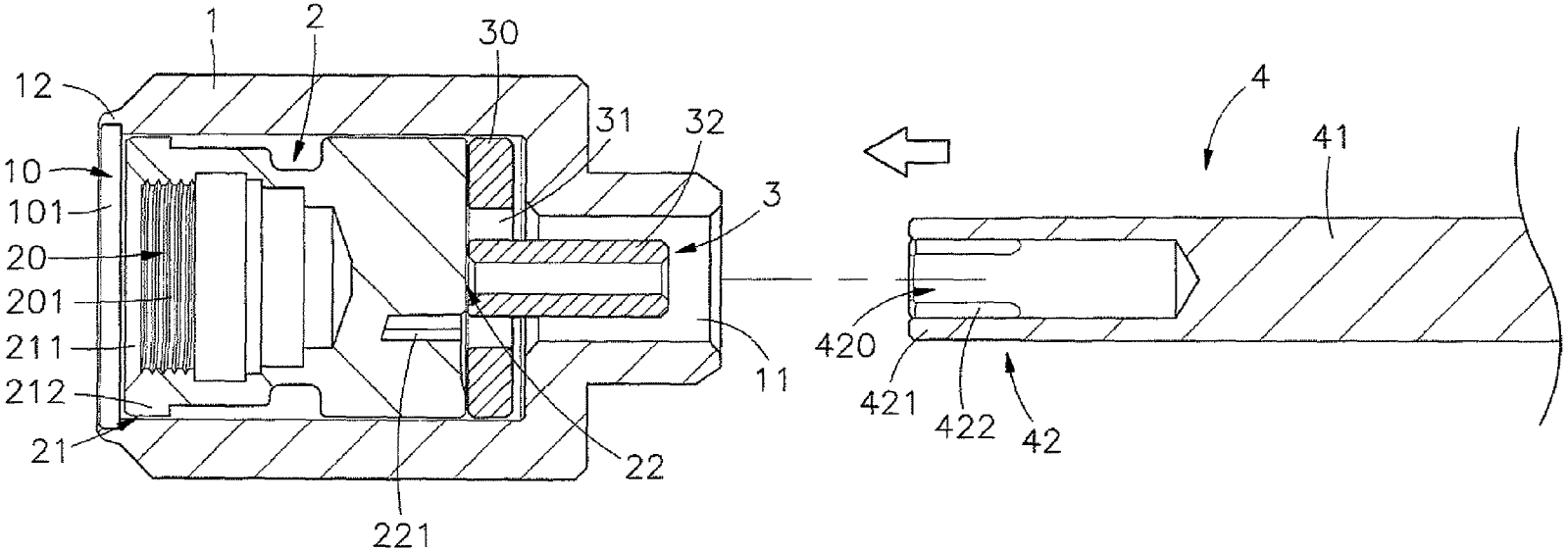
FIG. 5 is a sectional side view of the present invention before insertion of the working tip of the hand tool into the signal connector anti-theft device.
Figure 6:
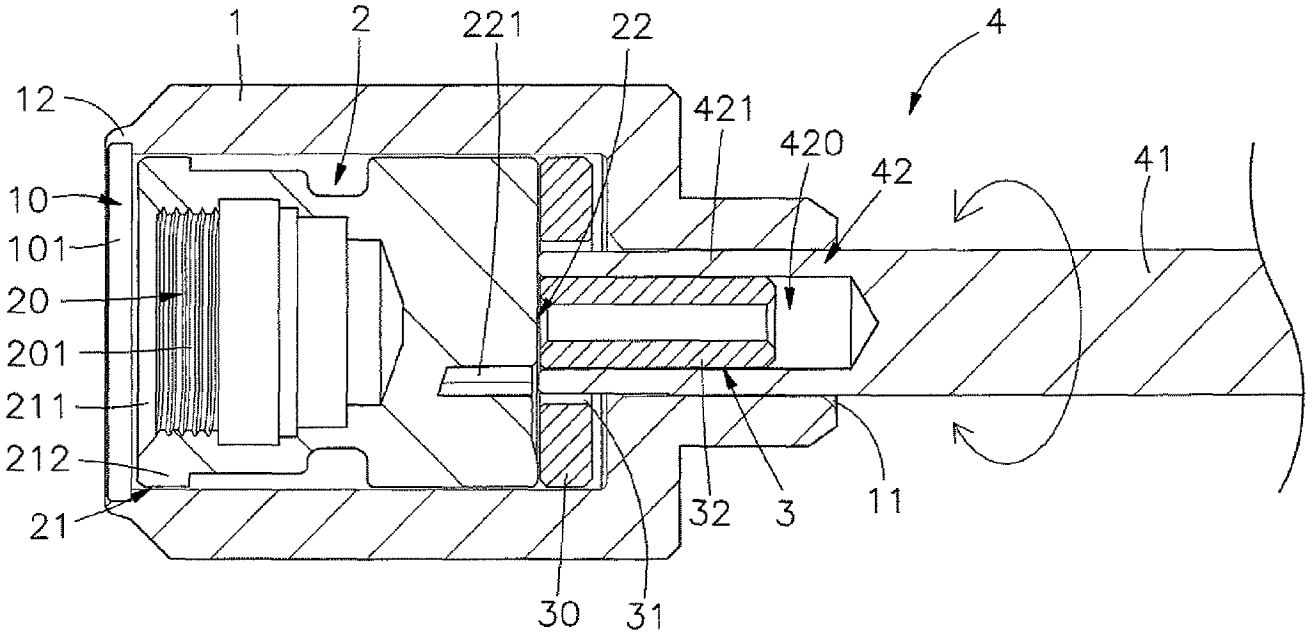
FIG. 6 corresponds to FIG. 5, illustrating the working tip of the hand tool inserted into the through holes of the rotating member and rotated.
Figure 7:
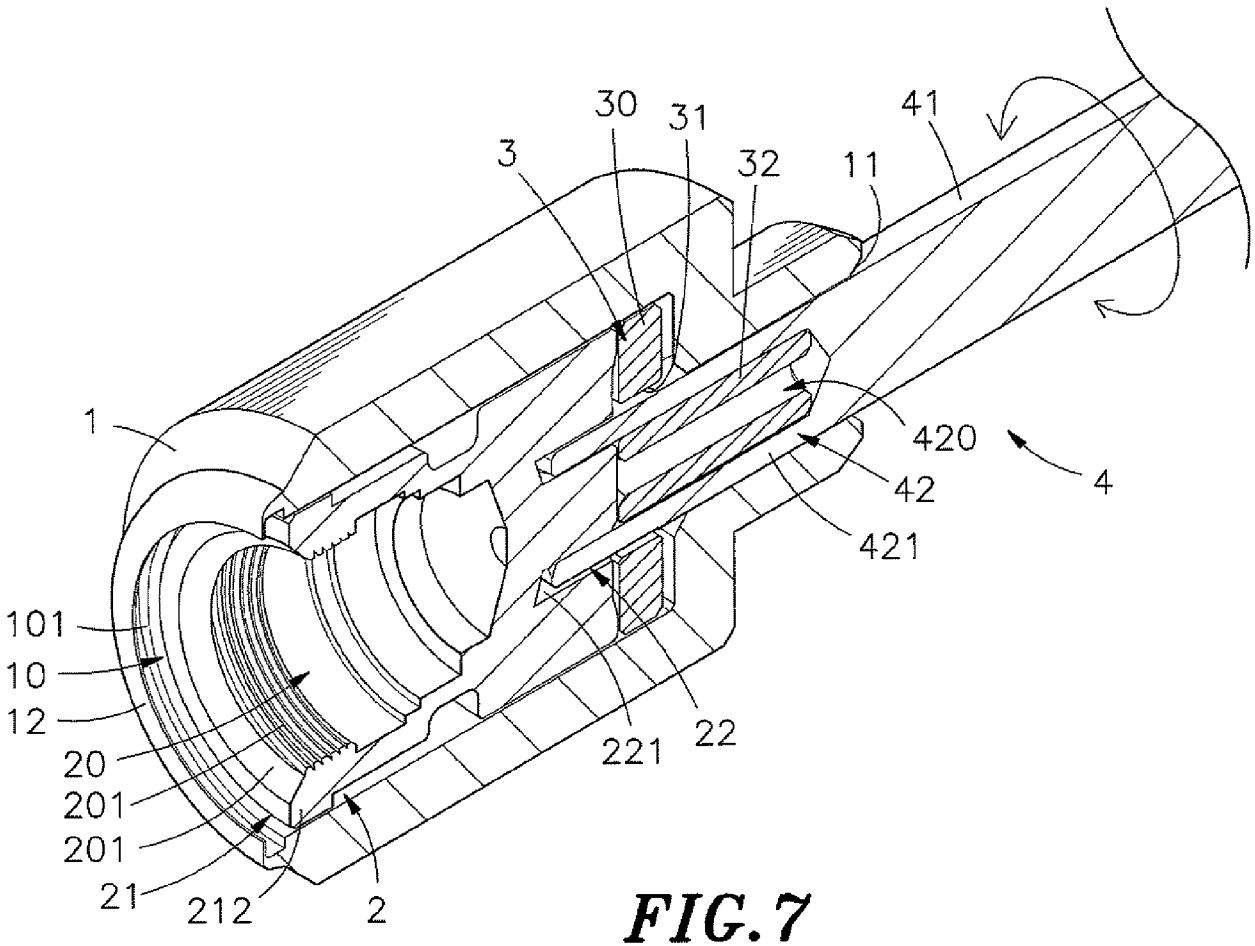
FIG. 7 corresponds to FIG. 6, illustrating the driving blocks of the working tip of the hand tool engaged into the driven structure of the locking member and rotated.
Figure 8:
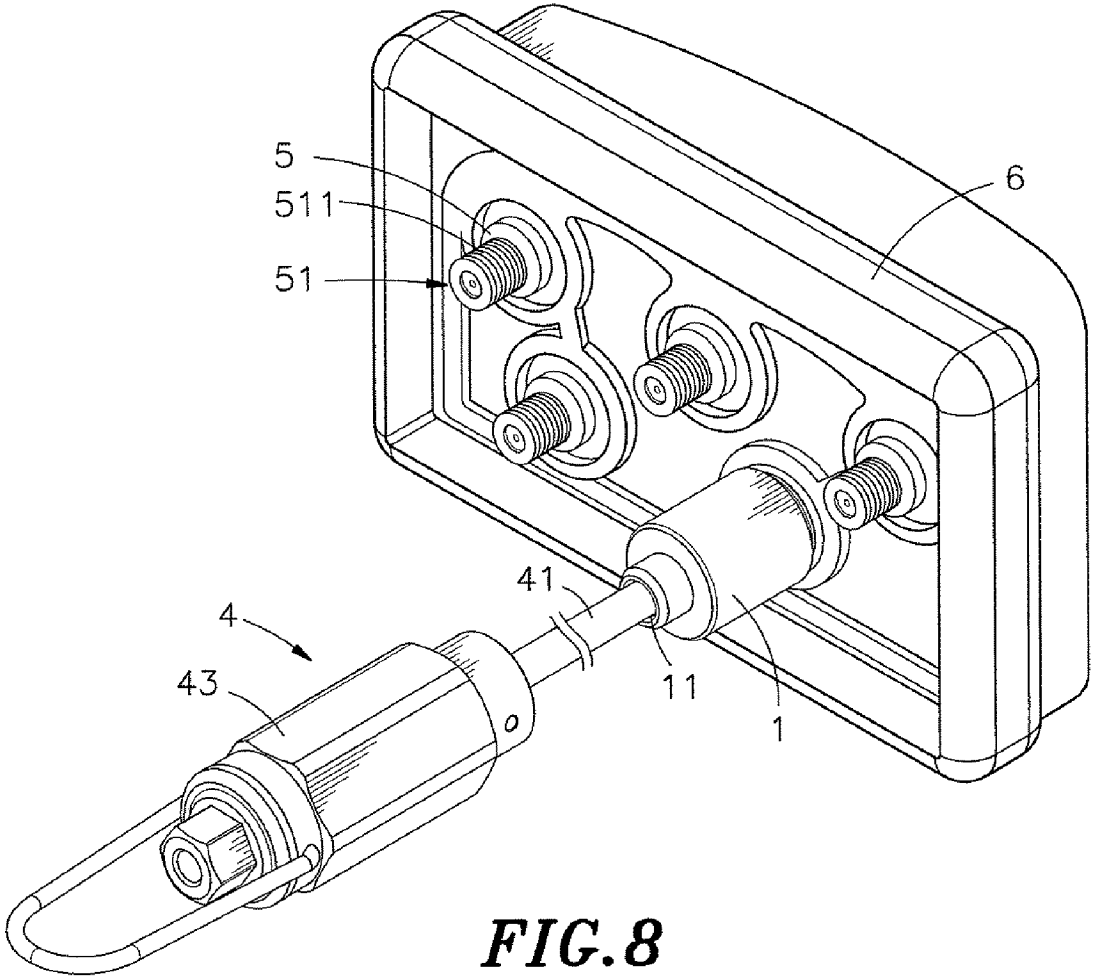
FIG. 8 is a schematic applied view of the present invention, illustrating the signal connector anti-theft device locked to a signal connector of an electronic implement.

Referring to FIGS. 1, 2, 3 and 4, a signal connector anti-theft device set in accordance with the present invention is shown. The signal connector anti-theft device set includes a hand tool 4, and a signal connector anti-theft device, which includes a cap 1, a locking member 2 and a rotating member 3.

The cap 1 is a hollow cylindrical member comprising an accommodation chamber 10 for accommodating the locking member 2 and the rotating member 3, a tubular neck 11 located on one end thereof in communication with the accommodation chamber 10, an opening 101 located on an opposite end thereof in communication with the accommodation chamber 10, and an end flange 12 extending around the opening 101.

The locking member 2 comprises a coupling chamber 20 therein, an inner thread 201 extending around the inside wall thereof within the coupling chamber 20, a coupling structure 21 located on one end thereof, which comprises a mating hole 211 kept in communication with the coupling chamber 20 and an annular stop flange 212 extending around the mating hole 211, and a driven structure 22 located on an opposite end thereof. The driven structure 22 can be rectangularly, archly, circularly, elliptically or polygonally configured, having radially extending ribs(or grooves) 221.

The rotating member 3 comprises a circular flat base 30, a shaft 32 vertically disposed at the center of the circular flat base 30, and a plurality of through holes 31 cut through the circular flat base 30 and spaced around the shaft 32.

The hand tool 4 comprises a tool shank 41, a working tip 42 located on one end of the tool shank 41, and a tool handle 43 located an opposite end of the tool shank 41. The working tip 42 comprises an axial hole 420, a plurality of driving blocks 421 spaced around the axial hole 420, and a plurality of axial slits 422 respectively defined between each two adjacent driving blocks 421.

Before application of the signal connector anti-theft device, the rotating member 3 is inserted through the opening 101 of the cap 1 into the accommodation chamber 10 to force the shaft 32 into the tubular neck 11 of the cap 1, and then the locking member 2 is inserted through the opening 101 into the accommodation chamber 10 and attached to the rotating member 3 to stop the annular stop flange 212 against the end flange 12 of the cap 1. Thus, the locking member 2 and the rotating member 3 are received in the cap 1 and can be rotated relative to the cap 1.

Referring to FIGS. 5, 6, 7 and 8, the signal connector anti-theft device of the present invention can be used in an electronic implement 6, for example, a signal distributor or adapter of a cable TV system. During installation, the user can hold the tool handle 43 of the hand tool 4 by hand and insert the working tip 42 and the tool shank 41 through the tubular neck 11 of the cap 1 into the accommodation chamber 10 to force the driving blocks 421 of the working tip 42 into the respective through holes 31 at the circular flat base 30 of the rotating member 3. If the through holes 31 of the rotating member 3 are not kept in perfect alignment with the driven structure 22 of the locking member 2 at this time, the driving blocks 421 of the working tip 42 will be stopped outside the radially extending ribs (or grooves) 221 of the driven structure 22 and prohibited from further forward movement. At this time, the user can rotate the tool handle 43 clockwise or counter-clockwise to move the rotating member 3 into perfect alignment with the driven structure 22 of the locking member 2, and then push the hand tool 4 forwards to force the driving blocks 421 of the working tip 42 into engagement with the radially extending ribs (or grooves) 221 of the driven structure 22. At this time, the depth of the axial slits 422 limits the insertion depth of the tool shank 41 in the accommodation chamber 10. Thus, the user can operate the tool handle 4 to rotate the locking member 2, locking the locking member 2 to one signal connector 5 of the electronic implement 6.

Further, when inserting the tool shank 41 of the hand tool 4 through the tubular neck 11 of the cap 1 into the accommodation chamber 10 toward the rotating member 3 and the locking member 2, the shaft 32 of the rotating member 3 will be received in the axial hole 420 of the working tip 42, allowing the driving blocks 421 of the working tip 42 to be forced into engagement with the radially extending ribs (or grooves) 221 of the driven structure 22. Thus, the design of the axial hole 420 of the working tip 42 provides a first stage of ant-theft function. After insertion of the driving blocks 421 of the working tip 42 through the through holes 31 of the rotating member 3 into engagement with the radially extending ribs (or grooves) 221 of the driven structure 22, the locking member 2 can be rotated by the working tip 42 of the hand tool 4 and locked to or unlocked from the corresponding signal connector 5 of the electronic implement 6. Thus, the mating design of the through holes 31 of the rotating member 3 and the driving blocks 421 and axial slits 422 of the working tip 42 provides a second stage of ant-theft function.

As stated above, after insertion of the driving blocks 421 of the working tip 42 through the through holes 31 of the rotating member 3 into engagement with the radially extending ribs (or grooves) 221 of the driven structure 22, the locking member 2 can be rotated by the working tip 42 of the hand tool 4 and locked to or unlocked from the corresponding signal connector 5 of the electronic implement 6. However, it is to be understood that the number, shape and angle of the through holes 31 of the rotating member 3 and the driving blocks 421 of the working tip 42 of the hand tool 4 in this embodiment are simply for the purpose of understanding but not limitation. After alignment between the through holes 31 of the rotating member 3 and the radially extending ribs (or grooves) 221 of the driven structure 22, the driving blocks 421 of the working tip 42 are forced through the through holes 31 of the rotating member 3 into engagement with the radially extending ribs (or grooves) 221 of the driven structure 22, and the other part of the circular flat base 30 of the rotating member 3 stop the tool shank 41 in position for rotating the locking member 2, achieving a third stage of anti-theft function.

When fastening the locking member 2 to the corresponding signal connector 5 of the electronic implement 6, attach the coupling structure 21 of the locking member 2 onto the connection stem 51 of the signal connector 5 to let the signal connection stem 51 be inserted through the mating hole 211 of the locking member 2 into the coupling chamber 20, and then operate the hand tool 4 to rotate the rotating member 3 and the locking member 2 relative to the signal connector 5, threading the inner thread 201 of the locking member 2 onto the outer thread 511 at the connection stem 51 of the signal connector 5. Thereafter, remove the hand tool 4 from the signal connector anti-theft device. Thus, the signal connector anti-theft device is locked to the signal connector 5 to shield the signal connector 5, prohibiting the signal connector 5 from being opened or unlocked illegally.

When going to unlock the signal connector anti-theft device from the signal connector 5, insert the driving blocks 421 of the working tip 42 through the through holes 31 of the rotating member 3 into engagement with the radially extending ribs (or grooves) 221 of the driven structure 22, and then operate the hand tool 4 to rotate the locking member 2 in the reversed direction, thereby disengaging the inner thread 201 of the locking member 2 from the outer thread 511 at the connection stem 51 of the signal connector 5, and thus, the signal connector anti-theft device is unlocked from the signal connector 5.

Figure 9:
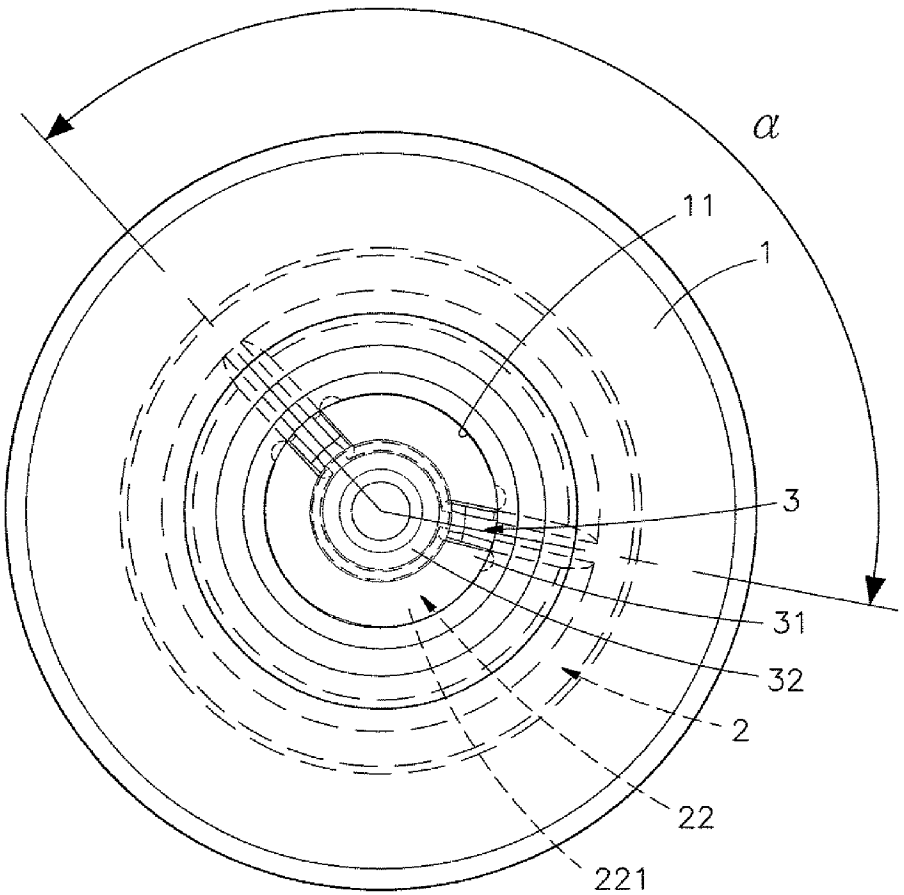
FIG. 9 is a schematic rear side view in an enlarged scale of an alternate form of the signal connector anti-theft device in accordance with the present invention.
Figure 10:
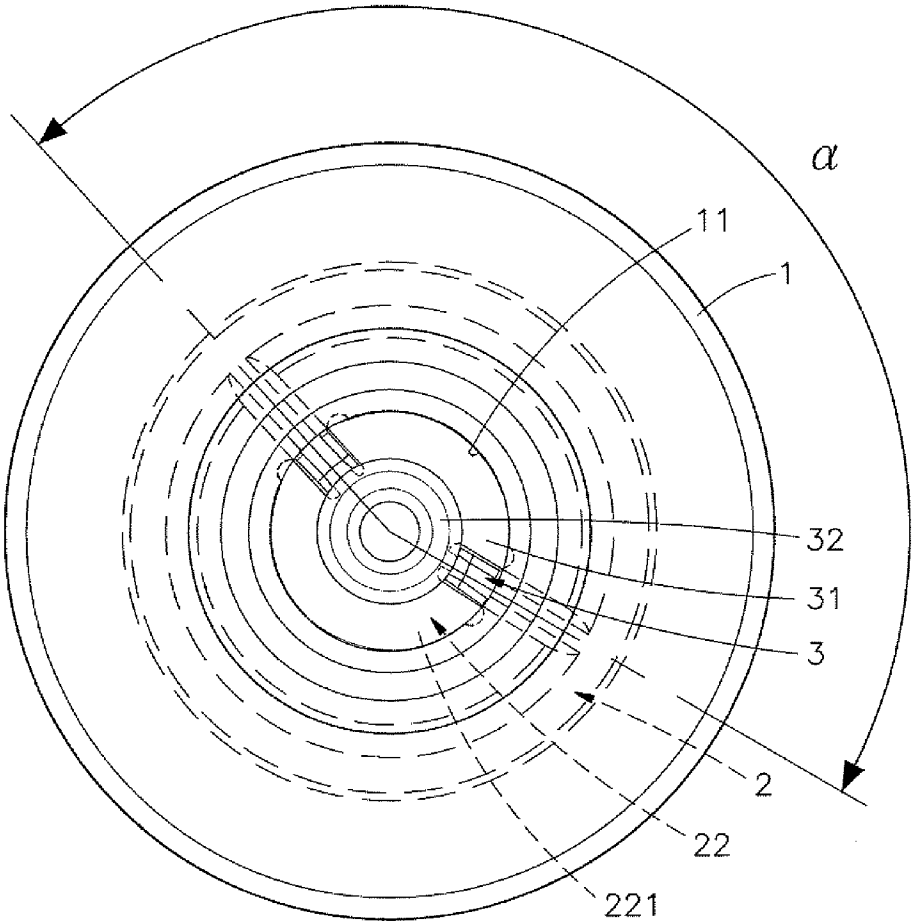
FIG. 10 is a schematic rear side view in an enlarged scale of another alternate form of the signal connector anti-theft device in accordance with the present invention.
Figure 11:
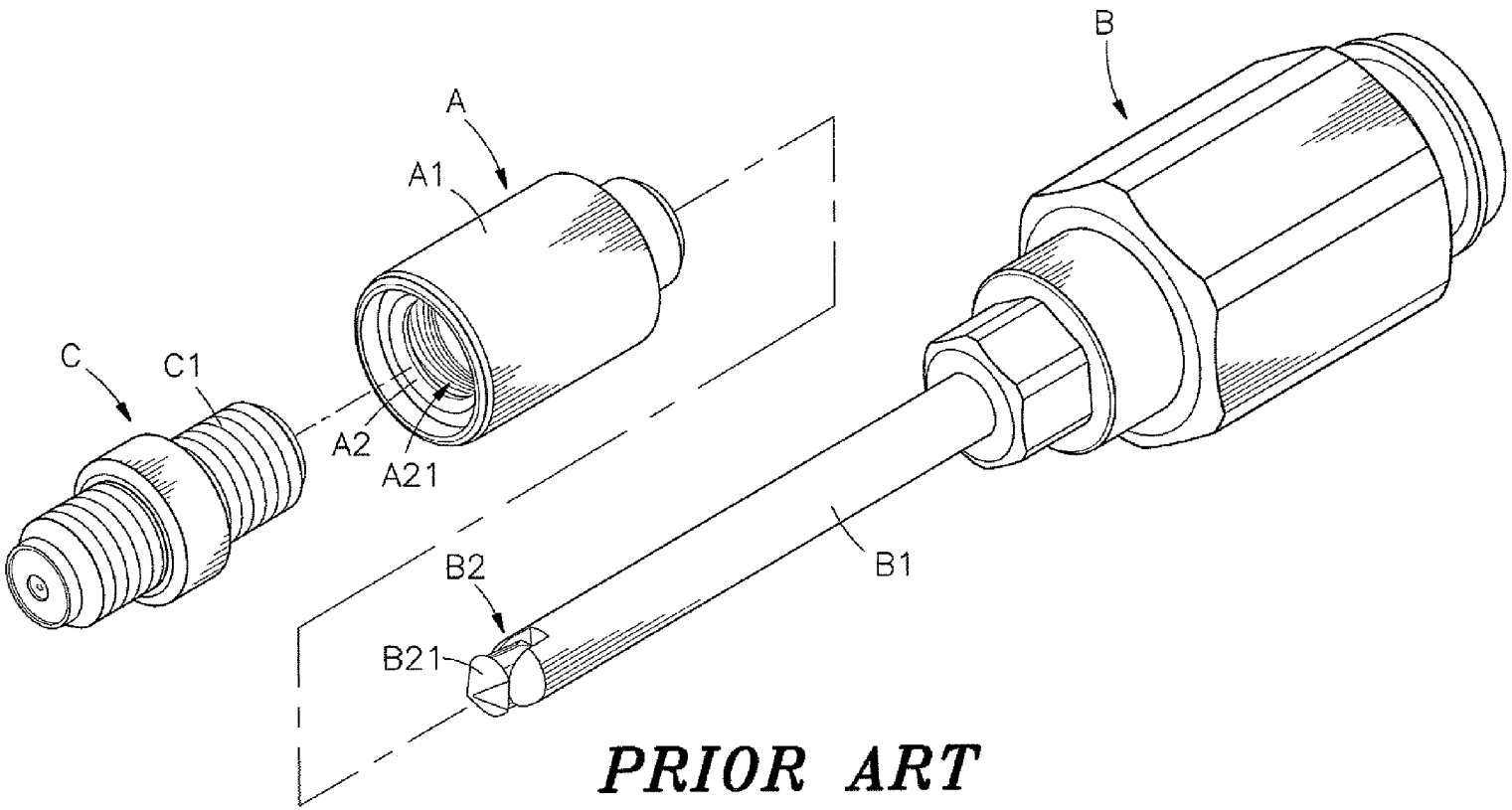
PRIOR ART FIG. 11
FIG. 11 is an exploded view of a signal connector anti-theft device set according to the prior art.
Figure 12:
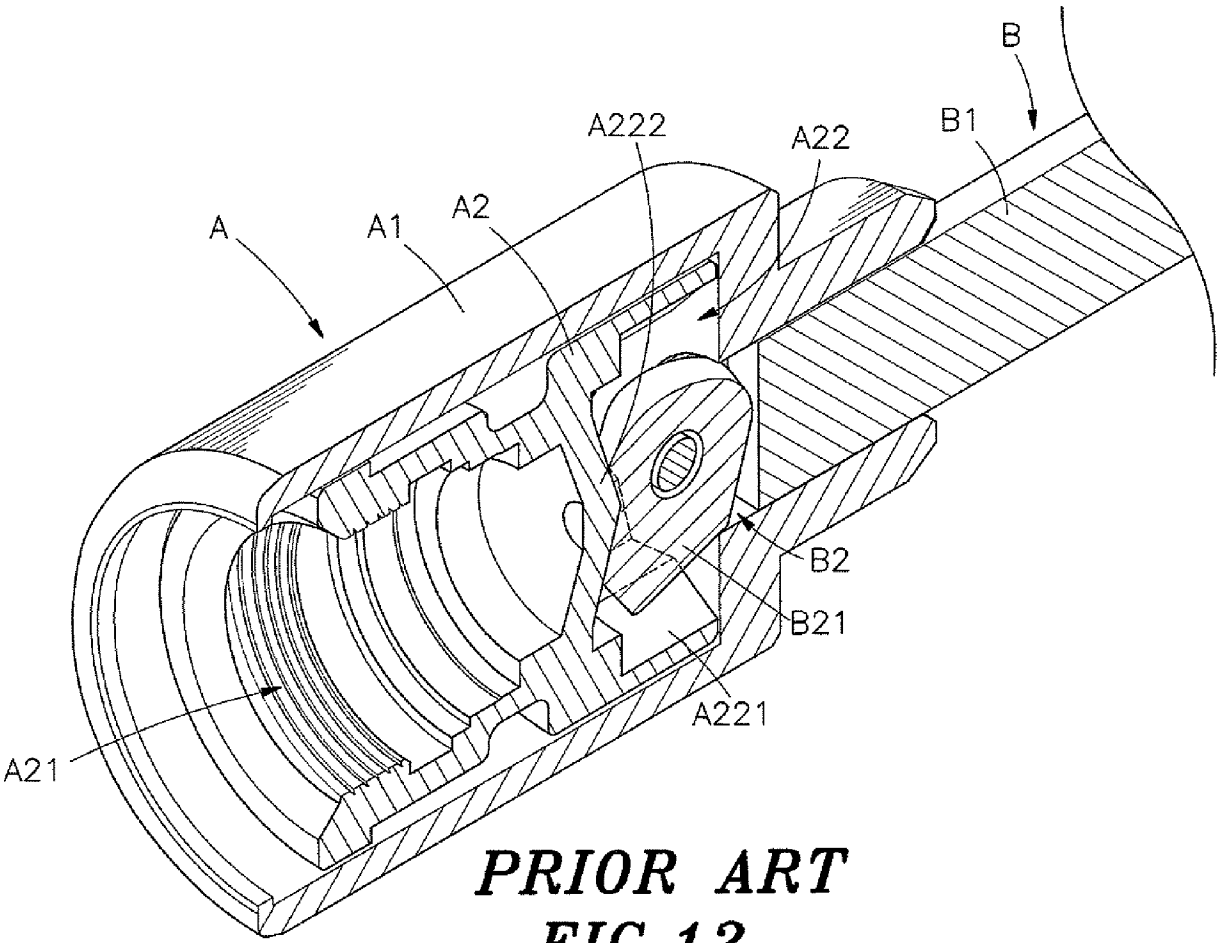
PRIOR ART FIG. 12
FIG. 12 is a sectional elevational assembly view, in an enlarged scale, of the signal connector anti-theft device set according to the prior art.

Referring to FIGS. 9 and 10 and FIG. 2 again, the number, shape and angle of the through holes 31 of the rotating member 3 and the number of the driving blocks 421 of the working tip 42 of the hand tool 4 may be variously embodied. In the embodiment shown in FIG. 2, the number, shape and angle of the through holes 31 of the rotating member 3 and the number of the driving blocks 421 of the working tip 42 of the hand tool 4 are 3. In actual practice, the number of the through holes 31 of the rotating member 3 and the number of the driving blocks 421 of the working tip 42 of the hand tool 4 can be 2, 4 or more. In the embodiments shown in FIGS. 9 and 10, the number of the through holes 31 of the rotating member 3 and the number of the driving blocks 421 of the working tip 42 of the hand tool 4 are 2. Further, the through holes 31 of the rotating member 3 and the driving blocks 421 of the working tip 42 of the hand tool 4 may be respectively spaced from one another at an equal angle or different angles. Further, the contained angle a defined between each two adjacent driving blocks (or any two driving blocks) 421 of the working tip 42 can be 120°, 155°, 165°, 195°, 205°, or any other angles. Further, the through holes 31 of the rotating member 3 and the driving blocks 421 of the working tip 42 of the hand tool 4 have be made having a rectangular, arched, circular, elliptical or polygonal shape. Subject to a particular shape and angular design of the driving blocks 421 of the working tip 42 of the hand tool 4, the hand tool 4 works as a custom-made key for locking the signal connector anti-theft device onto one signal connector 5 of the electronic implement 6, or unlocking the signal connector anti-theft device from the signal connector 5 of the electronic implement 6.

Referring to FIGS. 2, 4, 7 and 8 again, the working tip 42 at one end of the tool shank 41 of the hand tool 4 of the signal connector anti-theft device set is configured for insertion through the tubular neck 11 of the cap 1 of the signal connector anti-theft device and the through holes 31 of the rotating member 3 in the accommodation chamber 10 of the cap 1 into engagement with the radially extending ribs (or grooves) 221 of the driven structure 22 of the locking member 2 for locking the signal connector anti-theft device onto one signal connector 5 of the electronic implement 6, or unlocking the signal connector anti-theft device from the signal connector 5 of the electronic implement 6. Thus, the hand tool 4 works as a custom-made key for locking/unlocking the signal connector anti-theft device that consists of the cap 1, the locking member 2 and the rotating member 3.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A signal connector anti-theft device for fastening to a signal connector of an electronic implement for protection, the signal connector anti-theft device comprising:

a cap comprising an accommodation chamber, a tubular neck located on one end thereof in communication with said accommodation chamber, and an opening located on an opposite end thereof in communication with said accommodation chamber;

a rotating member set in said accommodation chamber, said rotating member comprising a circular flat base, a shaft vertically disposed at the center of said circular flat base and suspending in said tubular neck of said cap, and a plurality of through holes cut through said circular flat base and spaced around said shaft; and a locking member set in said accommodation chamber and abutted against said rotating member, said locking member comprising a coupling chamber for receiving said signal connector of said electronic implement, a coupling structure located on one end thereof for coupling to said signal connector of said electronic implement, and a driven structure located on an opposite end thereof and rotatable by an external hand tool being insertable through said tubular neck of said cap and said through holes of said rotating member.

2. The signal connector anti-theft device as claimed in claim 1, wherein said cap further comprises an end flange extending around the opening thereof; said coupling structure of said locking member comprises an annular stop flange stopped against said end flange of said cap.

3. The signal connector anti-theft device as claimed in claim 1, wherein said locking member further comprises an inner thread extending around an inside wall thereof within said coupling chamber, and a mating hole formed in said coupling structure for the passing of said signal connector of said electronic implement.

4. The signal connector anti-theft device as claimed in claim 1, wherein said driven structure is configured in one of rectangular, arch, circular, elliptical and polygonal shapes, having radially extending ribs.

5. A signal connector anti-theft device for fastening to a signal connector of an electronic implement for protection, the signal connector anti-theft device comprising:

a cap comprising an accommodation chamber, a tubular neck located on one end thereof in communication with said accommodation chamber, and an opening located on an opposite end thereof in communication with said accommodation chamber;

a rotating member set in said accommodation chamber, said rotating member comprising a circular flat base, and a plurality of through holes cut through said circular flat base;

a locking member set in said accommodation chamber and abutted against said rotating member, said locking member comprising a coupling chamber for receiving said signal connector of said electronic implement, a coupling structure located on one end thereof for coupling to said signal connector of said electronic implement, and a driven structure located on an opposite end thereof; and a hand tool insertable through said tubular neck of said cap and said through holes of said rotating member for rotating said locking member, said hand tool comprising a tool shank, a tool handle located one end of said tool shank and a working tip located on an opposite end of said tool shank, said working tip comprising a plurality of driving blocks insertable through said through holes of said rotating member and engageable into said driven structure of said locking member.

6. The signal connector anti-theft device as claimed in claim 5, wherein said cap further comprises an end flange extending around the opening thereof; said coupling structure of said locking member comprises an annular stop flange stopped against said end flange of said cap.

7. The signal connector anti-theft device as claimed in claim 5, wherein said locking member further comprises an inner thread extending around an inside wall thereof within said coupling chamber, and a mating hole formed in said coupling structure for the passing of said signal connector of said electronic implement.

8. The signal connector anti-theft device as claimed in claim 5, wherein said driven structure is configured in one of rectangular, arch, circular, elliptical and polygonal shapes, having radially extending ribs.

9. The signal connector anti-theft device as claimed in claim 5, wherein said rotating member comprises a shaft vertically disposed at the center of said circular flat base and suspending in said tubular neck of said cap; said working tip of said tool handle further comprises an axial hole surrounded by said driving blocks for receiving said tubular neck of said cap.

10. The signal connector anti-theft device as claimed in claim 5, wherein said working tip of said tool handle further comprises a plurality of axial slits respectively defined between each two adjacent said driving blocks.

11. The signal connector anti-theft device as claimed in claim 5, wherein said driving blocks of said working tip of said tool handle are configured in one of rectangular, arch, circular, elliptical and polygonal shapes, and spaced from one another at a respective predetermined angle.

* * * * *